US008959911B2

(12) United States Patent
Deneszczuk et al.

(10) Patent No.: US 8,959,911 B2
(45) Date of Patent: Feb. 24, 2015

(54) ENGINE ASSEMBLY INCLUDING FLUID CONTROL TO BOOST MECHANISM

(75) Inventors: William C. Deneszczuk, Saline, MI (US); Mary T. Lapres-Bilbrey, Brighton, MI (US); Michael Simon, Plymouth, MI (US); Nieyuan Hai, Ann Arbor, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 498 days.

(21) Appl. No.: 13/267,092

(22) Filed: Oct. 6, 2011

(65) Prior Publication Data

US 2013/0086903 A1 Apr. 11, 2013

(51) Int. Cl.

| | |
|---|---|
| ***F02B 33/44*** | (2006.01) |
| ***F02B 39/14*** | (2006.01) |
| ***F01D 25/18*** | (2006.01) |
| ***F01M 9/00*** | (2006.01) |
| ***F01M 5/02*** | (2006.01) |
| *F02D 41/04* | (2006.01) |
| *F02N 11/08* | (2006.01) |

(52) U.S. Cl.

CPC ..... *F01M 5/025* (2013.01); *F02D 41/042* (2013.01); *F02N 11/0814* (2013.01); *F02B 39/14* (2013.01)

USPC ..... 60/605.3; 184/6.11; 184/6.3

(58) Field of Classification Search

CPC ..... F02B 39/14; F02B 39/10; F02B 39/005; F01M 5/025; F01M 2011/021; F01M 1/02; F01P 3/12; F02D 23/00; F02D 41/042; F01D 25/125; F01D 25/186; F05B 2220/40; F16C 32/0644; F02N 11/0814; Y02T 10/144; Y02T 10/6286

USPC ..... 60/605.3, 607, 608; 417/407; 184/6.3, 184/6.11; 123/196 S; 384/120

See application file for complete search history.

(56) References Cited

U.S. PATENT DOCUMENTS

| | | | | | |
|---|---|---|---|---|---|
| 3,057,436 | A | * | 10/1962 | Jacobson et al. | 60/605.3 |
| 3,761,146 | A | * | 9/1973 | Unno et al. | 384/120 |
| 3,827,236 | A | * | 8/1974 | Rust | 60/605.3 |
| 3,927,530 | A | * | 12/1975 | Braun | 60/608 |
| 4,058,981 | A | * | 11/1977 | Henson | 60/605.3 |
| 4,083,188 | A | * | 4/1978 | Kumm | 60/608 |
| 4,107,927 | A | * | 8/1978 | Gordon et al. | 417/407 |
| 4,126,997 | A | * | 11/1978 | Henson | 60/605.3 |
| 4,142,608 | A | * | 3/1979 | Sarle | 184/6.11 |
| 4,322,949 | A | * | 4/1982 | Byrne et al. | 60/607 |
| 4,331,112 | A | * | 5/1982 | Pluequet | 123/196 S |

(Continued)

FOREIGN PATENT DOCUMENTS

| | | | | | |
|---|---|---|---|---|---|
| CN | 2888093 | Y | | 4/2007 | |
| GB | 2133481 | A | * | 7/1984 | F16C 37/00 |

(Continued)

*Primary Examiner* — Thai Ba Trieu

(74) *Attorney, Agent, or Firm* — Harness, Dickey & Pierce, P.L.C.

(57) ABSTRACT

A powertrain assembly includes an internal combustion engine, a boost mechanism and a fluid supply mechanism. The boost mechanism is in communication with an air source and the internal combustion engine. The fluid supply mechanism includes a first accumulator in communication with a pressurized fluid supply from the internal combustion engine and the boost mechanism. The accumulator receives pressurized fluid from the internal combustion engine during engine operation and provides the pressurized fluid to the boost mechanism during an engine off condition.

10 Claims, 2 Drawing Sheets

(56) References Cited

U.S. PATENT DOCUMENTS

| | | | | | |
|---|---|---|---|---|---|
| 4,422,295 | A | * | 12/1983 | Minami et al. | 60/605.3 |
| 4,513,704 | A | * | 4/1985 | Evans | 60/605.3 |
| 4,513,705 | A | * | 4/1985 | Evans | 60/605.3 |
| 4,690,572 | A | * | 9/1987 | Sasaki | 384/120 |
| 4,717,318 | A | * | 1/1988 | Elpern | 417/407 |
| 4,722,663 | A | * | 2/1988 | Swearingen | 415/168.2 |
| 4,752,193 | A | * | 6/1988 | Horler | 417/407 |
| 4,784,586 | A | * | 11/1988 | Ho | 417/407 |
| 4,884,406 | A | * | 12/1989 | Kawamura | 60/605.3 |
| 4,926,641 | A | * | 5/1990 | Keller | 60/605.3 |
| 4,928,637 | A | * | 5/1990 | Naitoh et al. | 60/605.3 |
| 4,958,600 | A | * | 9/1990 | Janthur | 60/605.3 |
| 5,000,143 | A | * | 3/1991 | Brown | 123/196 S |
| 5,014,820 | A | * | 5/1991 | Evans | 123/196 S |
| 5,102,305 | A | * | 4/1992 | Bescoby et al. | 417/407 |
| 5,308,169 | A | * | 5/1994 | Baker et al. | 417/407 |
| 5,499,693 | A | * | 3/1996 | Widenhorn | 184/6.24 |
| 5,870,894 | A | * | 2/1999 | Woollenweber et al. | 60/607 |
| 5,884,601 | A | * | 3/1999 | Robinson | 123/196 S |
| 5,967,762 | A | * | 10/1999 | Keller et al. | 417/407 |
| 6,092,371 | A | * | 7/2000 | Feucht et al. | 60/602 |
| 6,745,568 | B1 | * | 6/2004 | Squires | 60/605.3 |
| 6,874,998 | B2 | * | 4/2005 | Roby | 417/407 |
| 8,015,810 | B2 | * | 9/2011 | Theobald | 60/605.3 |
| 8,226,351 | B2 | * | 7/2012 | Shashank et al. | 415/112 |
| 8,393,152 | B2 | * | 3/2013 | Nishida | 60/605.3 |
| 8,474,259 | B2 | * | 7/2013 | Kistner et al. | 60/605.3 |
| 2010/0061855 | A1 | * | 3/2010 | Shashank et al. | 416/174 |
| 2010/0114454 | A1 | * | 5/2010 | French et al. | 123/196 S |
| 2011/0011077 | A1 | * | 1/2011 | Kozuka et al. | 60/445 |
| 2013/0047608 | A1 | * | 2/2013 | Shashank et al. | 60/605.3 |

FOREIGN PATENT DOCUMENTS

| | | | | | |
|---|---|---|---|---|---|
| JP | 59145331 | A | * | 8/1984 | F02B 39/14 |
| JP | 61123719 | A | * | 6/1986 | F02B 39/14 |
| JP | 01080720 | A | * | 3/1989 | F02B 39/14 |
| JP | 08158876 | A | * | 6/1996 | F02B 39/00 |
| JP | 2005009434 | A | * | 1/2005 | F02B 39/14 |

* cited by examiner

ENGINE ASSEMBLY INCLUDING FLUID CONTROL TO BOOST MECHANISM

FIELD

The present disclosure relates to engine boost mechanisms, and more specifically to control of fluid supplied to an engine boost mechanism.

BACKGROUND

This section provides background information related to the present disclosure which is not necessarily prior art.

Internal combustion engines may combust a mixture of air and fuel in cylinders and thereby produce drive torque. An engine may include a turbocharger to provide a compressed air flow to the engine. Oil may be provided to a bearing region of the turbocharger for lubrication and cooling during engine operation.

SUMMARY

A powertrain assembly may include an internal combustion engine, a boost mechanism and a fluid supply mechanism. The boost mechanism may be in communication with an air source and the internal combustion engine. The fluid supply mechanism may include a first accumulator in communication with a pressurized fluid supply from the internal combustion engine and the boost mechanism. The accumulator may receive pressurized fluid from the internal combustion engine during engine operation and may provide the pressurized fluid to the boost mechanism during an engine off condition.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
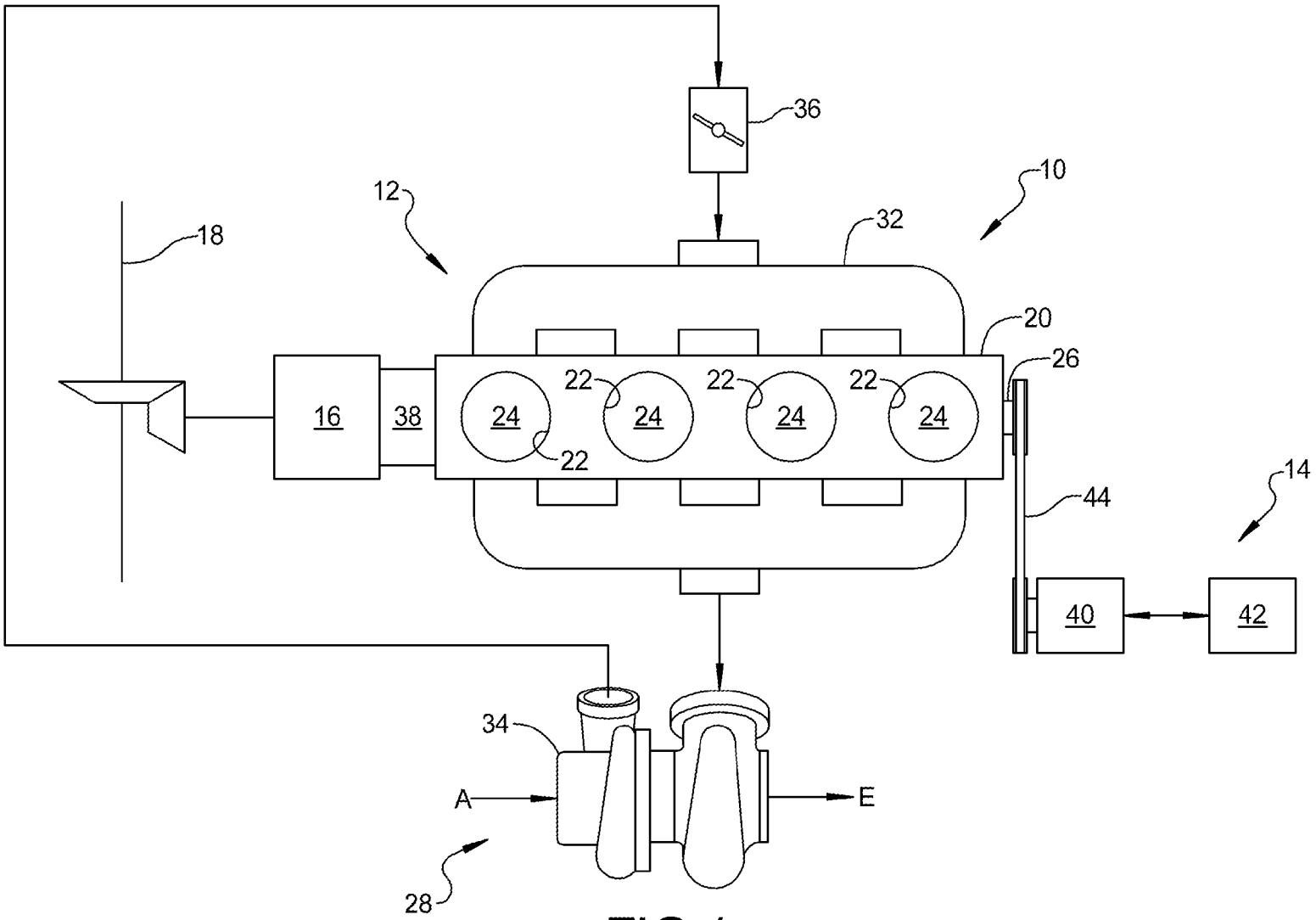
FIG. 1 is a schematic illustration of a vehicle assembly according to the present disclosure.
Figure 2:
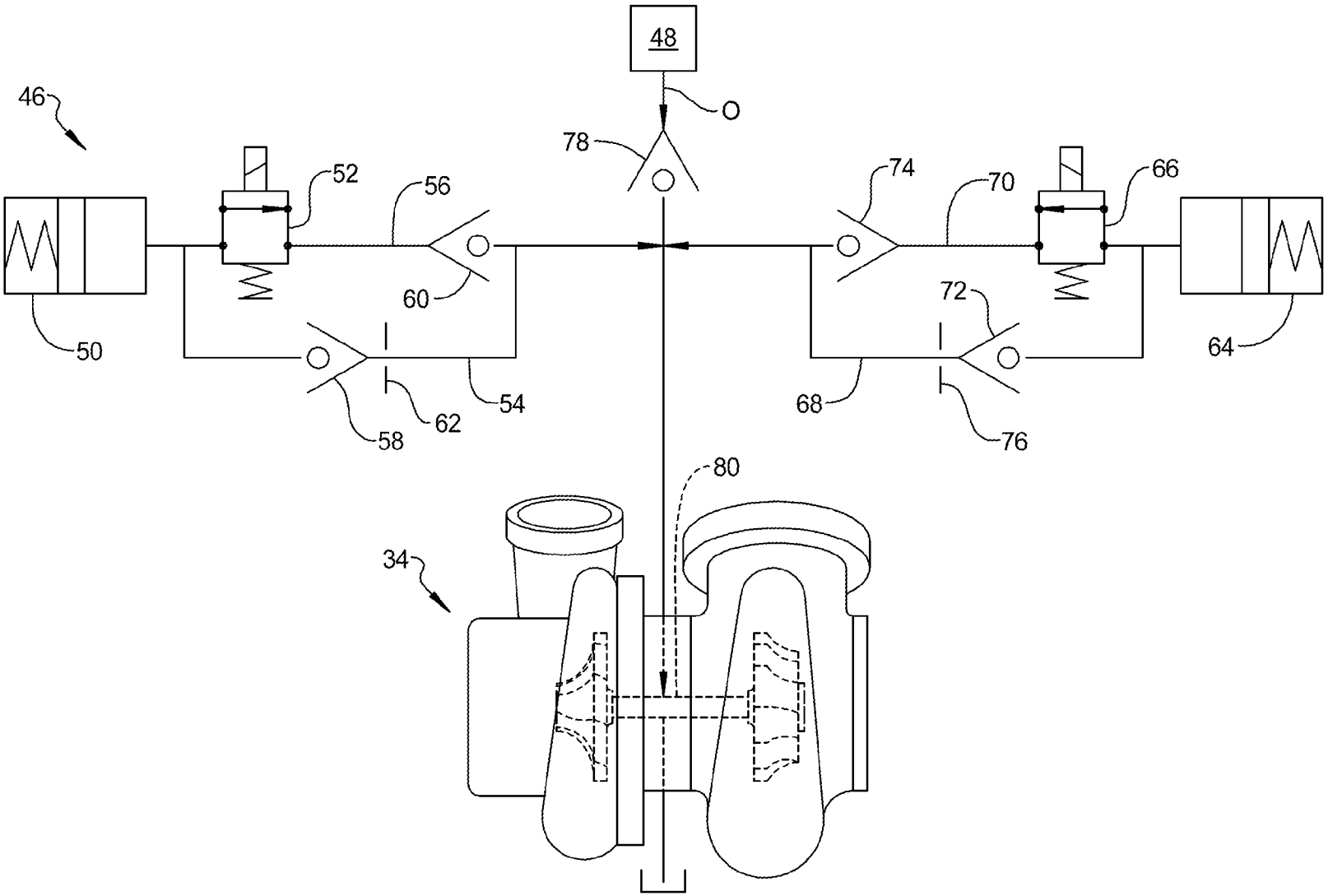
FIG. 2 is a schematic illustration of the boost mechanism and fluid supply from the engine assembly of FIG. 1.

A hybrid vehicle 10 is schematically illustrated in FIG. 1 and may include an engine assembly 12, a hybrid power assembly 14, a transmission 16 and a drive axle 18 driven by the transmission 16. The engine assembly 12 may include an internal combustion engine 20 defining cylinders 22 housing pistons 24 engaged with a crankshaft 26 and an intake system 28. While the internal combustion engine 20 is illustrated as a four cylinder engine configuration, it is understood that the present teachings apply to any number of piston-cylinder arrangements and a variety of reciprocating engine configurations including, but not limited to, V-engines, inline engines, and horizontally opposed engines, as well as both overhead cam and cam-in-block configurations.

The intake system 28 may supply air (A) to the cylinders 22 and may include an intake manifold 32 in communication with the cylinders 22 and a boost mechanism 34 in communication with the air source (A) and the intake manifold 32 to provide a compressed air flow to the cylinders 22 via the intake manifold 32. A throttle control valve 36 may be located between the boost mechanism 34 and the intake manifold 32 to control air flow to the intake manifold 32. While described in combination with a gasoline engine, it is understood that the present disclosure applies equally to diesel engines as well.

The engine assembly 12 may drive the transmission 16 via a coupling device 38 engaged with the crankshaft 26 and the transmission 16. By way of non-limiting example, the coupling device 38 may include a friction clutch or a torque converter. The hybrid power assembly 14 may include a motor 40 in communication with a rechargeable battery 42. In the present non-limiting example, the motor 40 is coupled to the crankshaft 26 via a belt 44.

In a first operating mode, combustion within the cylinders 22 may power rotation of the crankshaft 26 to propel the vehicle 10. The crankshaft 26 may additionally power rotation of the motor 40 to charge the battery 42 during the first mode. In a second mode, the internal combustion engine 20 may be non-operational (i.e., no combustion within the cylinders 22) and the motor 40 may be powered by the battery 42 and may drive rotation of the crankshaft 26. It is understood that the present disclosure is not limited to hybrid arrangements where the crankshaft 26 is driven by a motor of a hybrid system and applies equally to any hybrid propulsion system. The vehicle 10 may also be operated in a stop-start mode where the internal combustion engine 20 is temporarily shut off during vehicle stop conditions while the vehicle is still operating (e.g., temporary traffic stops).

The engine assembly 12 may include a fluid supply mechanism 46 associated with the boost mechanism 34. In the present non-limiting example, the boost mechanism 34 is illustrated as a turbocharger driven by exhaust gas (E) and the fluid supply mechanism 46 provides lubrication and/or cooling during transitions of the internal combustion engine 20 between on and off conditions. However, it is understood that the present disclosure is not limited to boost mechanisms including a turbocharger and applies equally to a variety of alternate arrangements including, but not limited to, superchargers.

The fluid supply mechanism 46 may be in communication with a pressurized fluid supply (O) from the engine assembly 12. In the present non-limiting example, the pressurized fluid supply (O) is provided by an engine lubrication system 48 and includes engine oil. The fluid supply mechanism 46 may include a first accumulator 50, a first control valve 52, a first flow path 54, a second flow path 56, a first check valve 58, a second check valve 60, a first orifice 62, a second accumulator 64, a second control valve 66, a third flow path 68, a fourth flow path 70, a third check valve 72, a fourth check valve 74, a second orifice 76 and a fifth check valve 78.

The engine lubrication system 48 may provide oil to the boost mechanism 34 during operation of the internal combustion engine 20. More specifically, the engine lubrication system 48 may be in communication with a bearing region 80 of the boost mechanism 34. The oil may lubricate and cool the bearing region 80. The first flow path 54 may provide pressurized oil to the first accumulator 50 and the second flow path 56 may provide oil from the first accumulator 50 to the boost mechanism 34. The second flow path 56 may be in a parallel flow arrangement to the first flow path 54. For example, the first and second flow paths 54, 56 may form parallel flow paths between the pressurized fluid supply (O) and the first accumulator 50.

The first check valve 58 may allow fluid flow to the first accumulator 50 and inhibit fluid flow from the first accumulator 50 to the boost mechanism 34 through the first flow path 54. The first orifice 62 may be located in the first flow path 54 and may meter flow to the first accumulator 50. The first control valve 52 may be located in the second flow path 56 and may control fluid communication between the first accumulator 50 and the boost mechanism 34 through the second flow path 56. The first control valve 52 may be a solenoid actuated valve selectively displaceable between open and closed positions. The second check valve 60 may be located in the second flow path 56 and may prevent backflow to the first accumulator 50.

The third flow path 68 may provide pressurized oil to the second accumulator 64 and the fourth flow path 70 may provide oil from the second accumulator 64 to the boost mechanism 34. The fourth flow path 70 may be in a parallel flow arrangement to the third flow path 68. For example, the third and fourth flow paths 68, 70 may form parallel flow paths between the pressurized fluid supply (O) and the second accumulator 64.

The third check valve 72 may allow fluid flow to the second accumulator 64 and inhibit fluid flow from the second accumulator 64 to the boost mechanism 34 through the third flow path 68. The second orifice 76 may be located in the third flow path 68 and may meter flow to the second accumulator 64. The second control valve 66 may be located in the fourth flow path 70 and may control fluid communication between the second accumulator 64 and the boost mechanism 34 through the fourth flow path 70. The second control valve 66 may be a solenoid actuated valve selectively displaceable between open and closed positions. The fourth check valve 74 may be located in the fourth flow path 70 and may prevent backflow to the second accumulator 64. The fifth check valve 78 may be located between the pressurized fluid supply (O) and the fluid supply mechanism 46 and may prevent backflow to the pressurized fluid supply (O) from the fluid supply mechanism 46.

During operation of the internal combustion engine 20, the first and second control valves 52, 66 may each be closed. Pressurized oil may be provided to the first accumulator 50 via the first flow path 54 and to the second accumulator 64 via the third flow path 68. The oil may be stored within the first and second accumulators 50, 64 until a predetermined vehicle operating condition. The first and second accumulators 50, 64 may provide oil to the bearing region 80 of the boost mechanism 34 during transitions to and from the stop-start mode.

By way of non-limiting example, when the internal combustion engine 20 is temporarily shut down at the beginning of the stop-start mode, the second control valve 66 may be displaced to the open position to provide cooling at the bearing region 80 of the boost mechanism 34. The first control valve 52 may remain in the closed position when the internal combustion engine 20 shut down. During a re-start condition of the internal combustion engine 20, such as a transition from the stop-start mode to operation of the internal combustion engine 20, the second control valve 66 may be in the closed position and the first control valve 52 may be displaced to the open position to provide lubrication to the bearing region 80 of the boost mechanism 34 at re-start of the internal combustion engine 20.

What is claimed is:

1. A method comprising:

providing a pressurized fluid from an internal combustion engine to an accumulator during operation of the internal combustion engine;

storing the pressurized fluid within the accumulator;

providing the stored pressurized fluid to a boost mechanism in communication with an air source and the internal combustion engine during an engine off condition; and providing the pressurized fluid to the accumulator via a first flow path and providing the pressurized fluid from the accumulator to the boost mechanism via a second flow path, the second flow path being in a parallel flow arrangement to the first flow path, a check valve allowing fluid flow to the accumulator through the first flow path and inhibiting fluid flow from the accumulator to the boost mechanism through the first flow path, and a control valve controlling fluid communication between the accumulator and boost mechanism through the second flow path.

2. The method of claim 1, wherein the control valve is a solenoid actuated valve selectively displaceable between open and closed positions and the first check valve and the control valve maintain a volume of pressurized fluid within the accumulator until the control valve is displaced to the open position.

3. A powertrain assembly comprising:

an internal combustion engine;

a boost mechanism in communication with an air source and the internal combustion engine;

a fluid supply mechanism including an accumulator in communication with a pressurized fluid supply from the internal combustion engine and the boost mechanism, the accumulator receiving pressurized fluid from the internal combustion engine during engine operation and providing the pressurized fluid to the boost mechanism during an engine off condition; and a solenoid actuated control valve in communication with the accumulator and the boost mechanism, the solenoid actuated control valve isolating the accumulator from communication with the boost mechanism during engine operation and providing communication between the accumulator and the boost mechanism during the engine off condition, wherein the fluid supply mechanism includes a first flow path providing the pressurized fluid to the accumulator and a second flow path providing the pressurized fluid from the accumulator to the boost mechanism, the second flow path being in a parallel flow arrangement to the first flow path, the fluid supply mechanism including a check valve allowing fluid flow to the accumulator and inhibiting fluid flow from the accumulator to the boost mechanism through the first flow path, and the solenoid actuated control valve being controlled by a control unit for controlling fluid communication between the accumulator and the boost mechanism through the second flow path.

4. The powertrain assembly of claim 3, further comprising a hybrid propulsion system, the internal combustion engine providing power to propel a vehicle including the powertrain assembly during a first operating mode and the hybrid propulsion system providing power to propel the vehicle during a second operating mode.

5. The powertrain assembly of claim 3, wherein the solenoid actuated control valve provides communication between the accumulator and the boost mechanism at an engine re-start condition.

6. The powertrain assembly of claim 5, wherein the fluid supply mechanism is in communication with an engine lubrication system and the pressurized fluid includes engine oil from the engine lubrication system, the solenoid actuated control valve providing communication between the accumulator and a bearing region of the boost mechanism to provide bearing lubrication at the engine re-start condition.

7. The powertrain assembly of claim 6, wherein the boost mechanism includes a turbocharger.

8. The powertrain assembly of claim 6, wherein the fluid supply mechanism includes an additional accumulator in communication with oil from the pressurized fluid supply and provides oil to the bearing region of the boost mechanism at an engine shutdown condition to provide cooling at the bearing region at engine shutdown.

9. The powertrain assembly of claim 3, wherein the check valve and the solenoid actuated control valve maintaining a volume of pressurized fluid within the accumulator until the solenoid actuated control valve is displaced to an open position.

10. The powertrain assembly of claim 8, further comprising an additional check valve in communication with the fluid supply mechanism and the pressurized fluid supply and allowing fluid flow to the additional accumulator from the internal combustion engine and inhibiting fluid flow from the additional accumulator to the internal combustion engine.

* * * * *